US008400013B2

(12) United States Patent
Single

(10) Patent No.: US 8,400,013 B2
(45) Date of Patent: Mar. 19, 2013

(54) ELECTRICAL APPLIANCE

(75) Inventor: Ulrich Single, Penang (MY)

(73) Assignee: Robert Bosch GmbH, Stuttgart (DE)

( * ) Notice: Subject to any disclaimer, the term of this patent is extended or adjusted under 35 U.S.C. 154(b) by 333 days.

(21) Appl. No.: 12/811,023

(22) PCT Filed: Nov. 3, 2008

(86) PCT No.: PCT/EP2008/064852

§ 371 (c)(1),
(2), (4) Date: Jun. 28, 2010

(87) PCT Pub. No.: WO2009/083310

PCT Pub. Date: Jul. 9, 2009

(65) Prior Publication Data

US 2010/0283323 A1 Nov. 11, 2010

(30) Foreign Application Priority Data

Dec. 27, 2007 (DE) ..... 10 2007 062 797

(51) Int. Cl.
*H05K 1/02* (2006.01)

(52) U.S. Cl. ..... 307/42; 307/64

(58) Field of Classification Search ..... 307/64, 307/42

See application file for complete search history.

(56) References Cited

U.S. PATENT DOCUMENTS 5,294,839 A 3/1994 Jaeschke
6,489,725 B1 * 12/2002 Suzuki et al. ..... 315/159

FOREIGN PATENT DOCUMENTS

DE 102006061130 A1 7/2007

* cited by examiner

*Primary Examiner* — Robert L. Deberadinis
(74) *Attorney, Agent, or Firm* — Maginot, Moore & Beck

(57) ABSTRACT

The invention relates to an electrical device having a switching unit, which is provided for switching a power supply of a consumer unit, and a control unit for controlling the consumer unit. According to the invention, the electrical device includes a bridging unit provided for supplying power to the control unit when the power supply is switched off by the switching unit.

10 Claims, 4 Drawing Sheets

ELECTRICAL APPLIANCE

CROSS-REFERENCE TO RELATED APPLICATION

This application is a 35 USC 371 application of PCT/EP2008/064852 filed on Nov. 3, 2008.

BACKGROUND OF THE INVENTION

1. Field of the Invention

The invention is based on an electrical appliance.

2. Description of the Prior Art

An electrical appliance equipped with a switch unit and a control unit is already known. The switch unit is provided for switching a power supply to a consumer unit and the control unit is provided for controlling the consumer unit.

ADVANTAGES AND SUMMARY OF THE INVENTION

The invention is based on an electrical appliance with a switch unit provided for switching a power supply to a consumer unit and a control unit provided for controlling the consumer unit.

According to one proposal, the electrical appliance has a bridge unit provided to supply current to the control unit when the power supply is switched off by the switch unit. In this context, the term "provided" is understood to mean specially equipped and/or specially embodied and/or specially programmed. In addition, a "control unit" should be understood in particular to be a unit that is composed of a computing unit, an evaluating unit, a control unit, and/or a regulating unit; a control unit can be composed of a processor alone or in particular, can be composed of a processor accompanied by additional electronic components such as memory devices and/or electronic components such as a voltage stabilizing capacitor. Preferably, the control unit has a microcontroller. Also in this context, a "switch unit" should in particular be understood to be a unit that makes or breaks an electrically conductive connection between two components and/or contacts and has at least one switch element, in particular a mechanical switch element. Preferably, the present invention is used in electrical appliances equipped with a bipolar switch unit. Basically, however, it is also conceivable for them to be equipped with a monopolar switch unit. In this context, a "bridge unit" should in particular be understood to be a unit that uses a conductive connection to bridge over an electrical connection that has been broken by a switch unit. The bridge unit can be constituted in a structurally simple way by a power supply line and/or in a particularly advantageous way by additional components and/or units that perform additional functions such as changing a power-to-heat ratio. The embodiment according to the invention can be used to advantageously supply a voltage to electrical appliance electronics or to individual units and/or components such as the control unit, of the electrical appliance electronics, thus avoiding an undesirable warm-up time of the electrical appliance electronics when starting or switching on the consumer unit. In addition, the increased output of the electrical appliance can be achieved at the beginning of a work process and/or other auxiliary functions such as protective functions in the electrical appliance electronics can be achieved in a structurally simple fashion. The present invention has the particular advantage of being suitable for use in an electrical appliance that is embodied in the form of a power tool, in particular a hand-held power tool such as an angle grinder.

According to another proposal, the bridge unit is a voltage conversion unit. In this context, a "voltage conversion unit" should in particular be understood to be a unit that is provided for converting or changing an electrical current with an input voltage into an electrical current with an output voltage that differs from the input voltage. Preferably, the voltage conversion unit converts the input voltage to a lower output voltage that permits a low-energy stand-by mode, particularly of the control unit.

If the voltage conversion unit has a resistance unit, then a voltage can be converted in a structurally simple way. In particular, the resistance unit can be integrated into conventionally designed switching electronics of the electrical appliance in a particularly inexpensive way and it is thus possible for conventional, standard switching components to be inexpensively used in connection with the resistance unit. In this context, a "resistance unit" should in particular be understood to be a unit with at least one resistance element, in particular an ohmic resistance. Preferably, the resistance unit is constituted by a high-ohm resistance unit so that an advantageously low, inexpensive operating voltage can be implemented in the stand-by mode. Basically, however, it is also conceivable, instead of the resistance unit, for the voltage conversion unit to be equipped with other electrical components and/or units such as a capacitor, an induction coil, and/or other components and/or units deemed suitable by the person skilled in the art.

A structurally simple, component-saving conversion of the voltage, in particular a conversion of an input voltage to a considerably lower output voltage, can be achieved if the resistance unit has at least one high-ohm resistance element. In this context, a "high-ohm resistance element" should in particular be understood to be an element that has a resistance value in the range from approx. 5 kΩ to 20 kΩ. The resistance element can be constituted by a capacitor, an induction coil, and/or particularly preferably, a resistance.

According to another proposal, the electrical appliance has at least one contact point that connects the bridge unit conductively to an incoming power supply line. In this context, an "incoming power supply line" should in particular be understood to be a power supply line that is connected to a power outlet and is provided to supply current to the electrical appliance and/or an electrically conductive contact with an energy storage unit such as a rechargeable battery. The bridge unit can thus be situated before the switch unit along a current flow direction and conductively connected to the power supply line, thus achieving an advantageous permanent current supply to the control unit by means of the bridge unit when there is a current-carrying connection of the power supply line to an electrical power grid. Alternatively to this, the contact point can also be provided in the switch unit; in this case, the contact point is advantageously situated before a switch point of the switch unit along a current flow direction.

An electrically conductive contact between the bridge unit and the contact point can be achieved in a structurally simple fashion if the contact point and the bridge unit each have a respective contact element. Preferably, the contact point and the bridge unit each have two contact elements, permitting the bridge unit to bridge over a voltage supply in an electrical appliance equipped with a bipolar switch unit. If the electrical appliance has only a monopolar switch unit, then it is sufficient to provide the contact point and the bridge unit with only one contact element each. It is particularly advantageous for the contact elements to each be composed of a contact terminal, thus permitting achievement of a simple plug connection between the contact point and the bridge unit.

According to another proposed embodiment of the invention, the electrical appliance has an additional component that at least partially forms an assembly unit together with the bridge unit. In this context, an "assembly unit" should in particular be understood to be a unit that is installed in one piece during an assembly of the electrical appliance. This makes it advantageously possible to achieve savings with regard to additional components, space, and assembly complexity of the electrical appliance, and also makes it possible to achieve a particularly compact arrangement of the bridge unit.

According to another proposal, the assembly unit has at least one housing in which the additional component and the bridge unit are at least partially accommodated, making it possible to achieve a particularly compact, especially protected arrangement of the bridge unit and/or the additional component.

If the assembly unit also has a fixing material, then it is possible to achieve a particularly stable arrangement inside the assembly unit. In a particularly advantageous embodiment, the fixing material is composed of a casting compound such as Macromelt. Preferably, the fixing material or casting compound is dispensed into the housing of the assembly unit during a production process after the component and at least one component of the bridge unit have been placed therein and then hardens so that the components are situated in a particularly stable fashion and in fixed positions in relation to one another inside the assembly unit.

If the additional component is composed of a capacitor, in particular a decoupling capacitor, then at least two functional elements, which must be provided in the vicinity of the switch unit, can advantageously be accommodated in a particularly compact fashion inside the electrical appliance.

In an advantageous modification of the invention, the assembly unit has at least three contact elements, making it advantageously possible to achieve savings with regard to additional components, in particular additional lines and/or cable, and the assembly unit can be connected to via a minimal number of contacts and can be connected in an electrically conductive fashion to additional components. In this connection, it is particularly advantageous that a contact element is provided for connecting the bridge unit to an incoming power supply line in an electrically conductive. Preferably, the two other contact elements constitute connecting elements for the additional component.

According to another proposal, the assembly unit has an electrically conductive connection that is provided to connect the bridge unit to a connecting element of the additional component. This eliminates the need for providing additional contact elements, e.g. for the bridge unit, and enables a compact embodiment of the electrical appliance electronics.

BRIEF DESCRIPTION OF THE DRAWINGS

The invention is described in detail below in conjunction with the drawings, in which.

DESCRIPTION OF THE PREFERRED EMBODIMENTS

Figure 1:
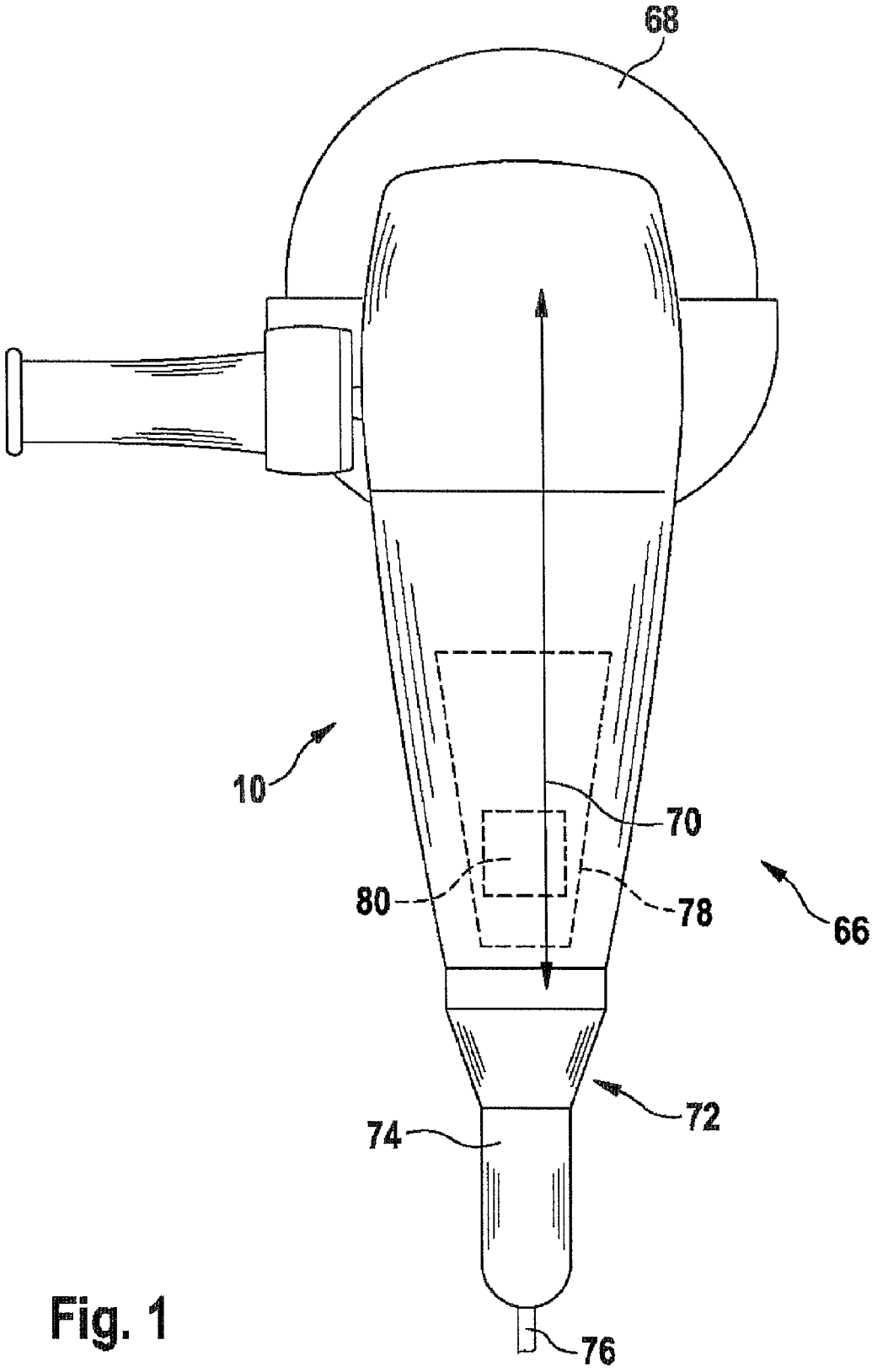
FIG. 1 is a schematic depiction of an electrical appliance embodied in the form of a hand-held power tool.

FIG. 1 schematically depicts an electrical appliance 10 embodied in the form of a hand-held power tool 66. The hand-held power tool 66 is embodied in the form of an angle grinder, which has a disk-shaped tool 68 that can be driven to rotate. The hand-held power tool 66 has a handle 74 at its end 72 remote from the tool 68 in a longitudinal direction 70. In a region of the handle 74, the hand-held power tool 66 also has a power cord 76 for connecting the hand-held power tool 66 to an electrical power grid. The power cord 76 supplies electrical energy to a set of electrical appliance electronics 78 and a motor unit 80.

Figure 2:
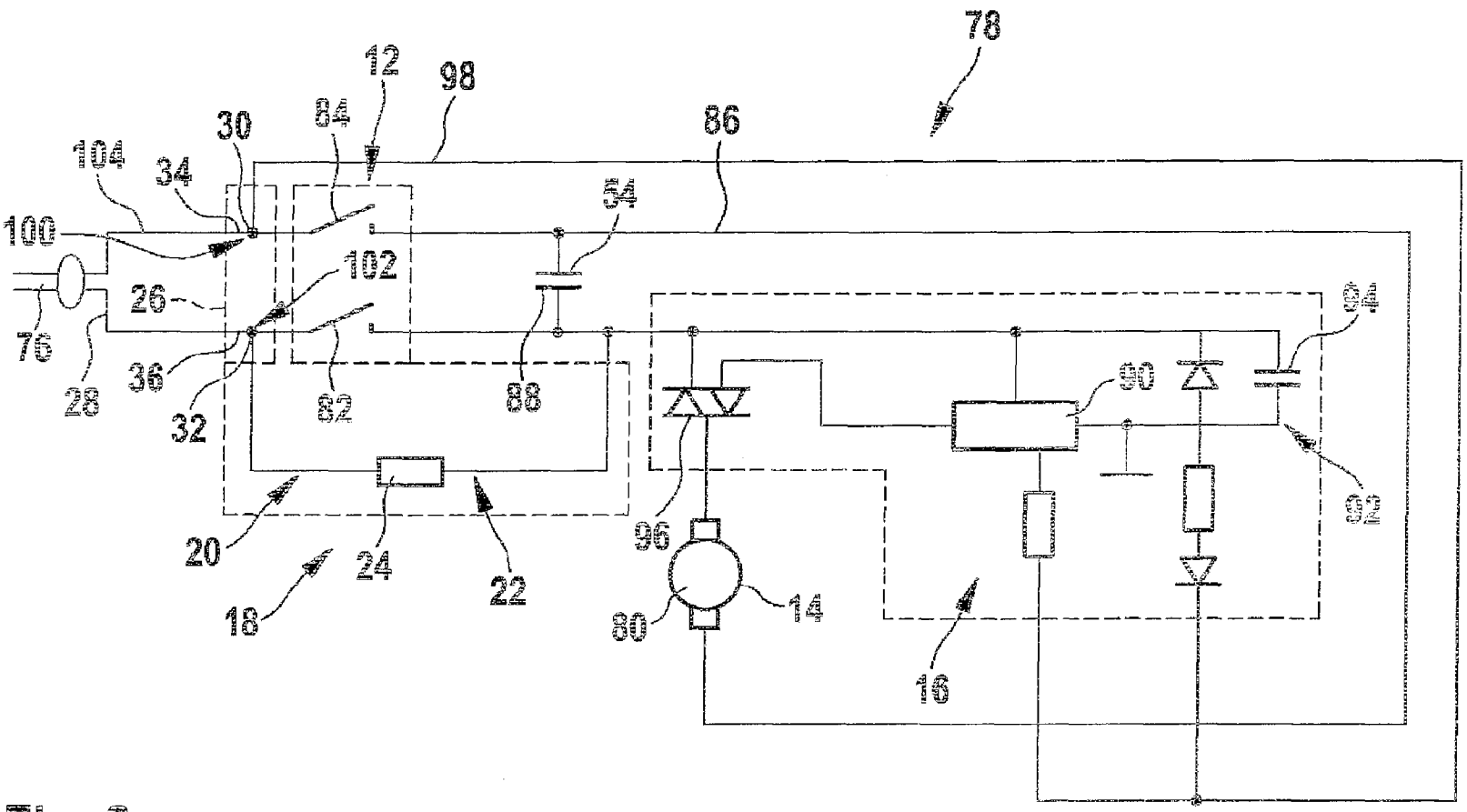
FIG. 2 is a circuit diagram of the electrical appliance electronics of the electrical appliance, equipped with a bridge unit.

FIG. 2 is a more detailed depiction of the electrical appliance electronics 78 of the hand-held power tool 66. The electrical appliance electronics 78 include a switch unit 12 that is embodied in the form of a bipolar switch unit 12. The switch unit 12, which has two switch contacts 82, 84, switches a current supply for a consumer unit 14 embodied in the form of the motor unit 80. In addition, the hand-held power tool 66 and the electrical appliance electronics 78 include an internal power supply line 86 that is situated between the motor unit 80 and the switch unit 12 and between the switch unit 12 and the power cord 76 and is provided to produce an electrically conductive connection between the power cord 76 and the motor unit 80 when the switch contacts 82, 84 of the switch unit 12 are closed. The power cord 76 is connected in an electrically conductive fashion to the internal power supply line 86 at a contact point.

In addition, the electrical appliance electronics 78 include a control unit 16, which is provided to control the motor unit 80 of the electrical appliance 10, and has a capacitor 54 embodied in the form of a decoupling capacitor 88, which reduces a transmission of interfering frequencies to the power grid during operation of the motor unit 80. For this purpose, the control unit 16 has a microcontroller 90, a voltage stabilizing unit 92 with a voltage stabilizing capacitor 94, and a semiconductor-based breaking element 96 that is connected between the microcontroller 90 and the motor unit 80. The semiconductor-based breaking element 96 in this case can be embodied in the form of a bidirectional thyristor triode and/or other elements deemed suitable by the person skilled in the art. Basically, it is also always conceivable, in an alternative embodiment of the electrical appliance electronics 78, to use an embodiment of the control unit 16 that differs from the variant of the control unit 16 described above and shown in FIG. 2. The electrical appliance electronics 78 also have a bridge unit 18 that is provided for supplying current to the control unit 16 if the current supply is switched off by the switch unit 12. In this case, the power cord 76 provides an electrically conductive connection between the electrical appliance 10 and the power grid and, because of a switching position of the switch contacts 82, 84, the motor unit 80 is in a switched-off operating state. The bridge unit 18 has a voltage conversion unit 20 that is provided to convert a high incoming grid voltage of the power grid into a low stand-by voltage for a stand-by mode of the control unit 16. For this purpose, the voltage conversion unit 20 has a resistance unit 22 equipped with a resistance element 24. The resistance element 24 is composed of a high-ohm resistance element 24 and has a resistance value of approx. 10 kΩ.

The high-ohm resistance element 24 bridges over a switch contact 82 of the switch unit 12. For bridging over the other switch contact 84, the bridge unit 18 has a continuous line element 98 that is of one piece with the internal power supply line 86. Basically, in lieu of the continuous line element 98, it is also conceivable to use an additional resistance element and/or another electrical component deemed suitable by the person skilled in the art such as an induction coil and/or a capacitor, etc.

At the contact point 26 of the electrical appliance 10 or the electrical appliance electronics 78, the bridge unit 18 is connected in an electrically conductive fashion to an incoming power supply line 28 of the power cord 76. For this purpose, the contact point 26 and the bridge unit 18 each have two respective contact elements 30, 32, and 34, 36, that are embodied in the form of a contact terminal 38, 40, 42 (see FIGS. 3 through 5). The contact point 26 in this case is composed of two angle contacts 100, 102 that respectively connect the incoming and outgoing power supply lines 28, 104 of the power cord 76 to two contact elements 30, 32 of the bridge unit 18 in an electrically conductive fashion. In addition, the contact elements 34, 36 or the angle contacts 100, 102 connect the internal power supply line 86 and the switch contacts 82, 84 to the power cord 76.

Figure 3:
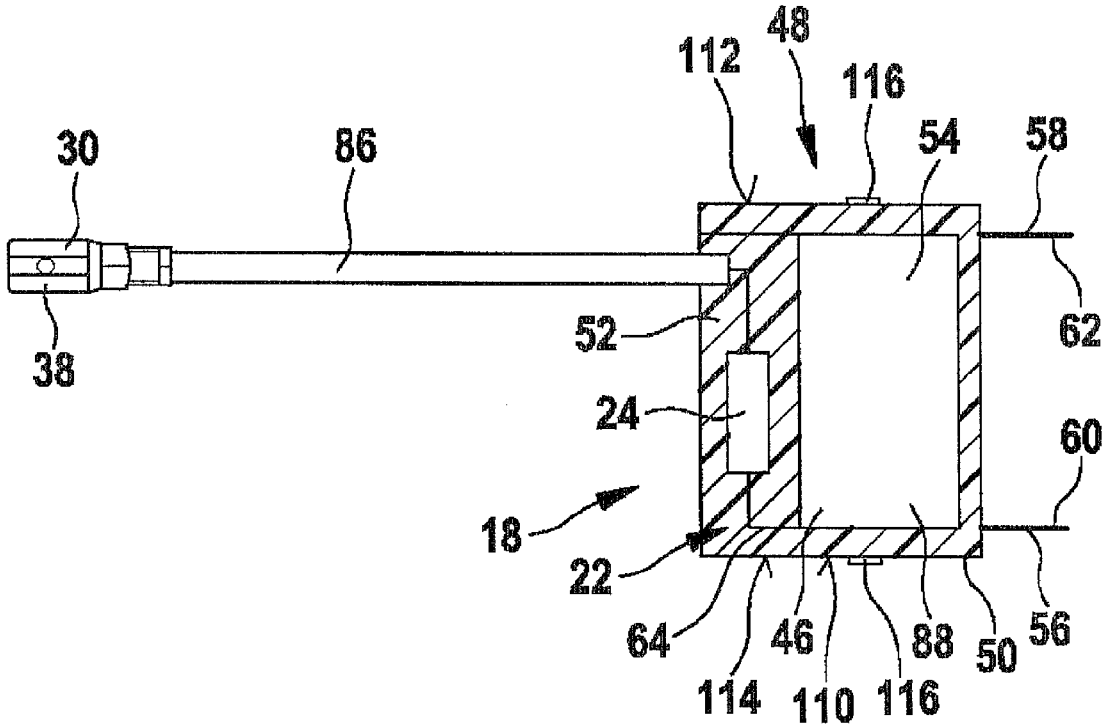
FIG. 3 is a schematic depiction of an assembly unit of the electrical appliance, equipped with a bridge unit and an additional component.

FIG. 3 schematically depicts a subregion of the bridge unit 18 equipped with the resistance unit 22. The high-ohm resistance element 24 comprises an assembly unit 48 together with another component 46 that is constituted by the decoupling capacitor 88. For this purpose, the assembly unit 48 has a housing 50 in which are situated the high-ohm resistance element 24 and the decoupling capacitor 88 embodied in the form of a capacitor winding. To fix the decoupling capacitor 88 and the high-ohm resistance element 24 together inside the housing 50 of the assembly unit 48, the assembly unit has a fixing material 52 that is embodied in the form of a casting compound such as Macromelt. The casting compound fixes the decoupling capacitor 88 and the high-ohm resistance element 24 in place inside the assembly unit 48.

The assembly unit 48 also has three contact elements 30, 56, 58; a contact element 30 is constituted by one of the contact terminals 38 of the bridge unit 18. The other two contact elements 56, 58 are constituted by connecting elements 60, 62 for the decoupling capacitor 88, which are embodied in the form of connecting pins. During an assembly procedure, the connecting elements 60, 62 can be used to insert the assembly unit 48 by means of a simple insertion procedure into contact elements of the electrical appliance electronics 78 and/or of the electrical appliance 10 that correspond to the connecting elements 60, 62 and are not shown in detail here (analogous to FIG. 4). In addition, the assembly unit 48 has an electrically conductive connection 64 that is provided to connect the high-ohm resistance element 24 to one of the connecting elements 60 of the decoupling capacitor 88 and the assembly unit 48 is thus provided with a minimum number of contact elements 30, 56, 58.

The housing of the assembly unit 48 also has a respective locking element 116 embodied in the form of a knob situated on opposite sides 110, 112, on each of the outward-facing surfaces 114. The locking elements 116, in cooperation with the contact terminal 38 and the connecting elements 60, 62, permit the assembly unit 48 to be installed in a structurally simple, captive fashion inside the electrical appliance 10 during an assembly process and removed in a structurally simple fashion if an unwanted defect occurs.

Figure 4:
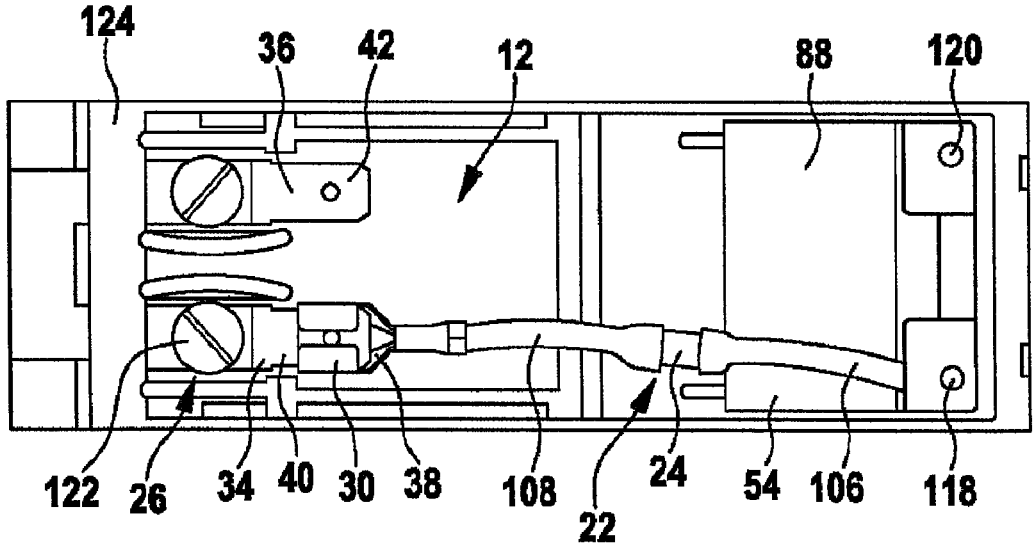
FIG. 4 is a schematic depiction of an embodiment of the bridge unit alternative to the one in FIG. 3, equipped with an additional component.
Figure 5:
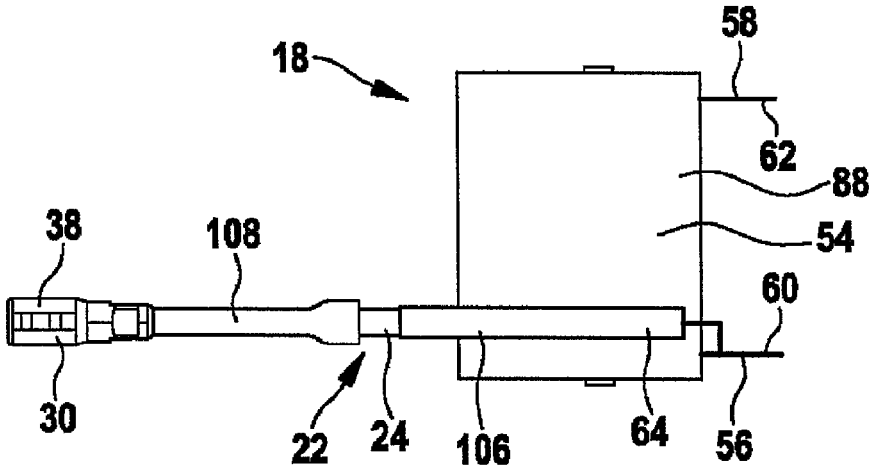
FIG. 5 is a schematic depiction of the bridge unit from FIG. 4, in an arrangement together with the additional component inside the electrical appliance.

FIGS. 4 and 5 show an arrangement of a decoupling capacitor 88 together with a high-ohm resistance element 88 of a bridge unit 18. The high-ohm resistance element 24 in this case is situated between two line segments 106, 108 of an internal power supply line 86. A connection between the high-ohm resistance element 24 and the decoupling capacitor 88 in this case is analogous to the description of FIG. 3. In addition, the resistance element 24, along with the decoupling capacitor 88, is connected to the internal power supply line 86 in a fashion analogous to the description of FIGS. 2 and 3.

Alternative to the embodiments of the invention shown in FIGS. 3 through 5, the bridge unit 18 and the resistance unit 22 with the high-ohm resistance element 24 can also be situated inside the electrical appliance electronics 78, independent of or separate from an embodiment or arrangement of the decoupling capacitor 88. For this purpose, only the bridge unit 18 or resistance unit 22 would have to have an additional contact point for contacting with the internal power supply line 86 inside the electrical appliance electronics 78.

FIG. 5 shows a partial detail of the electrical appliance 10 in addition to an arrangement of the decoupling capacitor 88, together with a resistance unit 22 in a region of a switch unit 12. A connection between the contact element 30 of the bridge unit 18, which contact is embodied in the form of a contact terminal 38, and a contact terminal 40 of the contact point 26 is produced by means of a simple plug connection of the two contact terminals 38, 40. The contact terminals 40, 42 in this case are embodied as U-shaped; only one leg of the U-shaped contact terminals 40, 42 is visible in FIG. 5. The legs of the U-shaped contact terminals 40, 42 are each connected to a housing 124 of the electrical appliance 10 at the contact point 26 by means of a respective screw 122. One leg of the U-shaped contact terminals 40, 42, which is not visible in FIG. 5, is provided to produce an electrical contact with power supply lines 28, 104 of a power cord 76. For this purpose, the power supply lines 28, 104 are fixed in place in a clamp, not shown in detail, such as a strip connector, of a conventional standard switch, together with the non-visible legs of the U-shaped contact elements 118, 120. The electrical appliance 10 also has two additional contact elements 118, 120 into which the connecting elements 60, 62 of the decoupling capacitor are inserted; these additional contact elements produce an electrically conductive contact with the electrical appliance electronics 78 and the internal power supply line 86.

Alternative to the embodiments in FIGS. 3 through 5, it is also conceivable for the contact elements 30, 32 of the bridge unit 18 to be embodied in the form of a braid and for this to be fastened to a contact screw of the contact point 26 and connected to the power supply lines 28, 104 of the power cord 76 in an electrically conductive fashion.

The foregoing relates to the preferred exemplary embodiments of the invention, it being understood that other variants and embodiments thereof are possible within the spirit and scope of the invention, the latter being defined by the appended claims.

The invention claimed is:

1. An electrical appliance comprising:

a switch unit, which is configured to selectively switch a current supply to a consumer unit, which has a control unit configured to control the consumer unit; and a bridge unit that is configured to supply current to the control unit when the switch unit has switched off the current supply to the consumer unit, the bridge unit including an assembly unit having a housing in which a voltage conversion unit and a capacitor are located, the voltage conversion unit and the capacitor being configured to enable electrical connections between the bridge unit and the control unit.

2. The electrical appliance as recited in claim 1 wherein the voltage conversion unit includes a resistance unit.

3. The electrical appliance as recited in claim 2 wherein the resistance unit includes at least one high-ohm resistance element.

4. The electrical appliance as recited in claim 1 further comprising:

at least one contact point that connects the bridge unit to an incoming power supply line in an electrically conductive fashion.

5. The electrical appliance as recited in claim 4 wherein each of the contact point and the bridge unit includes at least one contact element.

6. The electrical appliance as recited in claim 5 wherein the at least one contact element is a contact terminal.

7. The electrical appliance as recited in claim 1 wherein the voltage conversion unit and capacitor are positioned within the housing of the assembly unit with at least one fixing material.

8. The electrical appliance as recited in claim 1 wherein the assembly unit has at least three contact elements.

9. The electrical appliance as recited in claim 8 wherein at least one of the three contact elements is configured to connect the bridge unit to an incoming power supply line in an electrically conductive fashion.

10. The electrical appliance as recited in claim 8 wherein at least two of the three contact elements constitute connecting elements for the capacitor.

* * * * *